US009403538B2

(12) United States Patent
Erickson

(10) Patent No.: US 9,403,538 B2
(45) Date of Patent: Aug. 2, 2016

(54) EFFICIENT SAND TUB HEATER

(71) Applicant: Messiah Locomotive Services, Inc., Kimberling City, MO (US)

(72) Inventor: Jeremiah Erickson, Kimberling City, MO (US)

(73) Assignee: MESSIAH LOCOMOTIVE SERVICE, INC., Kimberling City, MO (US)

( * ) Notice: Subject to any disclaimer, the term of this patent is extended or adjusted under 35 U.S.C. 154(b) by 28 days.

(21) Appl. No.: 13/969,318

(22) Filed: Aug. 16, 2013

(65) Prior Publication Data

US 2014/0049054 A1 Feb. 20, 2014

Related U.S. Application Data

(60) Provisional application No. 61/684,012, filed on Aug. 16, 2012.

(51) Int. Cl.
*B61C 15/10* (2006.01)

(52) U.S. Cl.
CPC ..... *B61C 15/10* (2013.01)

(58) Field of Classification Search
CPC ..... B60B 39/00; B60B 39/02; B60B 39/021; B60B 39/022; B60B 39/024; B60B 39/04; B60B 39/06; B60B 39/10
USPC ..... 291/2, 25, 38–41, 44–46
See application file for complete search history.

(56) References Cited

U.S. PATENT DOCUMENTS

| | | | | |
|---|---|---|---|---|
| 1,404,903 | A | 1/1922 | Spencer | |
| 1,421,745 | A | 7/1922 | Taylor | |
| 1,528,552 | A * | 3/1925 | Johns | B61C 15/105 291/20 |
| 1,646,130 | A | 10/1927 | Waite | |
| 1,789,600 | A | 1/1931 | Schopp | |
| 1,800,548 | A | 4/1931 | Light et al. | |
| 1,850,795 | A | 3/1932 | Hoffmann | |
| 1,879,747 | A | 9/1932 | Hopkins | |
| 2,138,526 | A | 11/1938 | Nation | |
| 2,240,266 | A | 4/1941 | Nation | |
| 2,654,622 | A | 10/1953 | Foster | |
| 2,783,070 | A | 2/1957 | Saari et al. | |
| 3,827,736 | A | 8/1974 | Mango | |
| 4,459,473 | A * | 7/1984 | Kamath | H05B 3/56 219/505 |
| 4,575,135 | A | 3/1986 | Cervinka | |
| 4,747,627 | A | 5/1988 | Shigeura et al. | |
| 5,428,538 | A | 6/1995 | Ferri | |
| 6,629,709 | B1 | 10/2003 | Tunley et al. | |
| 6,789,824 | B1 | 9/2004 | Delp | |

* cited by examiner

*Primary Examiner* — R. J. McCarry, Jr.
(74) *Attorney, Agent, or Firm* — Lathrop & Gage LLP

(57) ABSTRACT

An efficient sand tube heater including a flexible heating element wrapped around a sand tube. The flexible heating element and sand tube are then surrounded by a heat sensitive sheathing. Heat is applied to the heat sensitive sheathing such that the heat sensitive sheathing shrinks around the flexible heating element and sand tube such that the flexible heating element remains in contact with the sand tube.

9 Claims, 3 Drawing Sheets

EFFICIENT SAND TUB HEATER

RELATED APPLICATIONS

This application claims priority to U.S. Provisional Application Ser. No. 61/684,012, filed Aug. 16, 2012 and entitled "Efficient Sand Tube Heater". The aforementioned application is incorporated by reference in its entirety herein.

BACKGROUND

Sand tubes are used to increase the amount of friction between a railroad track and the wheel of a train. Sand tubes are located at the front of a wheel and disperse sand along the track to allow greater friction during cold and icy weather between the wheel of the train and track. Sand tubes without heating systems require manually hitting the sand tube to break up the ice inside the tube. This can cause severe damage to the sand tube rendering the sand tube inoperable. United States Federal Regulations require that all trains to have sand tubes operable at all times and there is a significant fine if the tubes are frozen when inspected.

Typical prior art such as that shown in U.S. Pat. No. 1,528,552 implement heating systems for keeping the sand inside the sand tubes above freezing temperature to ensure that the sand is not frozen during operation. The prior art disclosed in U.S. Pat. No. 1,528,552 implements an electrical heated medium coiled around the lower portion of the sand tube. The electrical heated medium is then encased in a structure. The structure is then filled with a loose fire retardant material such as asbestos.

The prior art in U.S. Pat. No. 1,528,552 has disadvantages and difficulties in implementing an efficient and properly functioning sand tube. The heating element is not in constant connection to the sand tube, therefore does not efficiently heat the sand inside of the tube. Additionally, the structure surrounding the heating element is difficult to maintain when repairs are needed.

Another such prior art reference U.S. Pat. No. 2,654,622 discloses a heating system which uses hot liquid traveling through coils wrapped around the sand tube and forced air provided by the locomotive to keep the sand from freezing and to keep the sand dispensing tube freely operable. This invention has difficulties and disadvantages in that the heating coils do not rise to a sufficient heat temperature to keep the sand from freezing during very low temperatures. Therefore, even with such methods of heating the sand, the sand tube can still freeze where the hot water inside the coils does not sufficiently heat the sand inside of the tube.

Other methods of heating the sand inside the tube include using engine exhaust, heat provided off of the engine, or other circulated heated liquids. However, these methods fail to properly heat the sand to an adequate temperature during extreme cold.

SUMMARY

In accordance with one embodiment, a system for heating and dispersing sand in front of a vehicle's wheels including a sand tube, a flexible heating element coiled around the sand tube, a heat sensitive sheathing wrapped around the sand tube and flexible heating element, and an electrical thermostat controller coupled to the electrical heating element. The heat sensitive sheathing is shrunk around the electrical heating element and sand tube to insure constant contact between the sand tube and electrical heating element. The thermostat controller is controlled by an operator to vary the amount of heat produced by the electrical heating element.

In accordance with one embodiment, a method for heating and dispersing sand in front of a vehicle's wheels including wrapping a flexible electrical heating element around a tube for holding and dispersing sand; wrapping a heat sensitive sheathing around the tube and flexible electrical heating element; applying heat to the heat sensitive sheathing to compact the flexible electrical heating element so that it is in constant contact with the tube. The electrical heating element is then coupled to a thermostat controller to allow exact control of the heat provided by the electrical heating element.

DETAILED DESCRIPTION OF THE EMBODIMENTS

Figure 1:
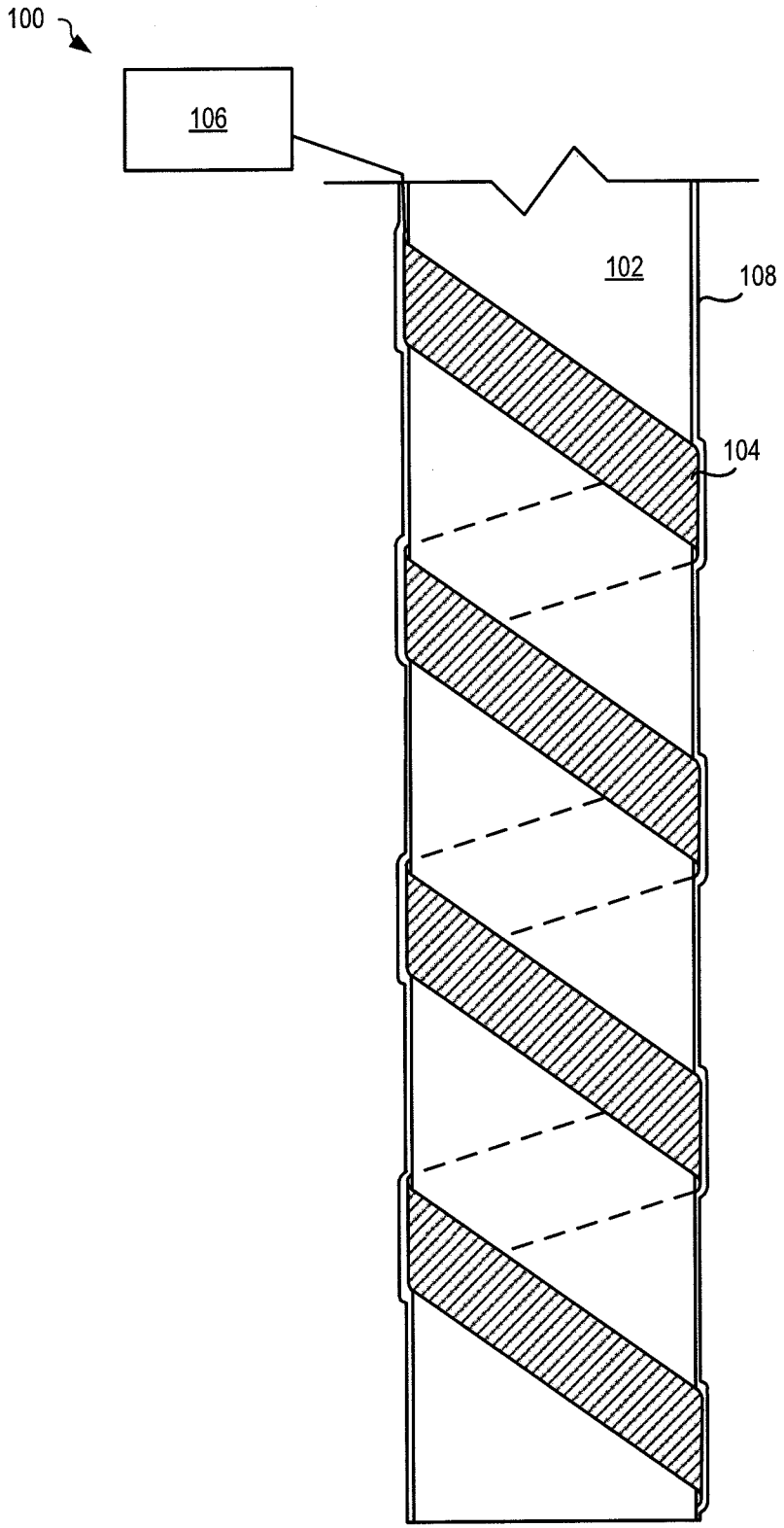
FIG. 1 shows an exemplary heated sand tube system.

FIG. 1 shows one exemplary sand tube system 100 for dispersing sand for use in a vehicle. The sand tube 102 is for example sized and shaped to fit onto a locomotive train. Although not illustrated, sand tube 102 may further have a valve at the distal end such to control distribution of the sand. The sand tube 102 is then wrapped with a flexible electrical heating element 104. In one embodiment, electrical heating element 104 may reach temperatures up to 400 degrees Fahrenheit. For example, electrical heating element 104 can be realized, by using an Asr Duo-Tape® as manufactured by HTS/Amptek Company. Electrical heating element 104 is then coupled to a thermostat controller 106 to produce temperatures of up to 400 degrees Fahrenheit. The thermostat controller 106 is capable of allowing an exact control of temperature. The thermostat controller 106 may be realized, in one embodiment, using a TX Series CE 0081 thermostat controller available from Barksdale, Inc. The sand tube 102 and electrical heating element 104 are then wrapped with a heat sensitive sheathing 108. Heat is then applied to the heat sensitive sheathing 108 which causes the heat sensitive sheathing 108 to shrink around the electrical heating element 104 and sand tube 102. As the heat sensitive sheathing 108 shrinks, the sheathing causes the electrical heating element 104 to come into direct contact with the sand tube 102 ensuring an efficient conduction of heat from the heating element 104 to the sand tube 102. The heat sensitive sheathing 108 is also made of sufficient durability and thickness to protect the electrical heating element 104 from damage during operation of the locomotive.

Figure 2:
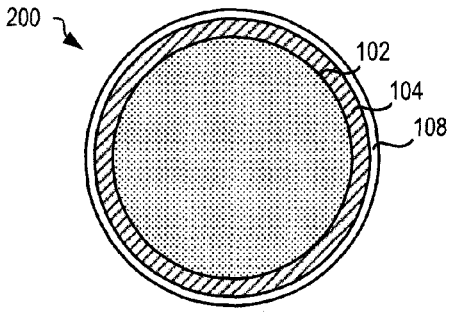
FIG. 2 shows a cross sectional view of an exemplary heated sand tube system.

FIG. 2 shows an exemplary cross sectional view 200 of the sand tube system 100 after heat is applied to the heat sensitive sheathing 108. As shown in FIG. 2, the heat sensitive sheathing 108 fully surrounds the electrical heating element 104 and sand tube 102. Additionally, the electrical heating element 104 is in direct contact with sand tube 102.

Figure 3:
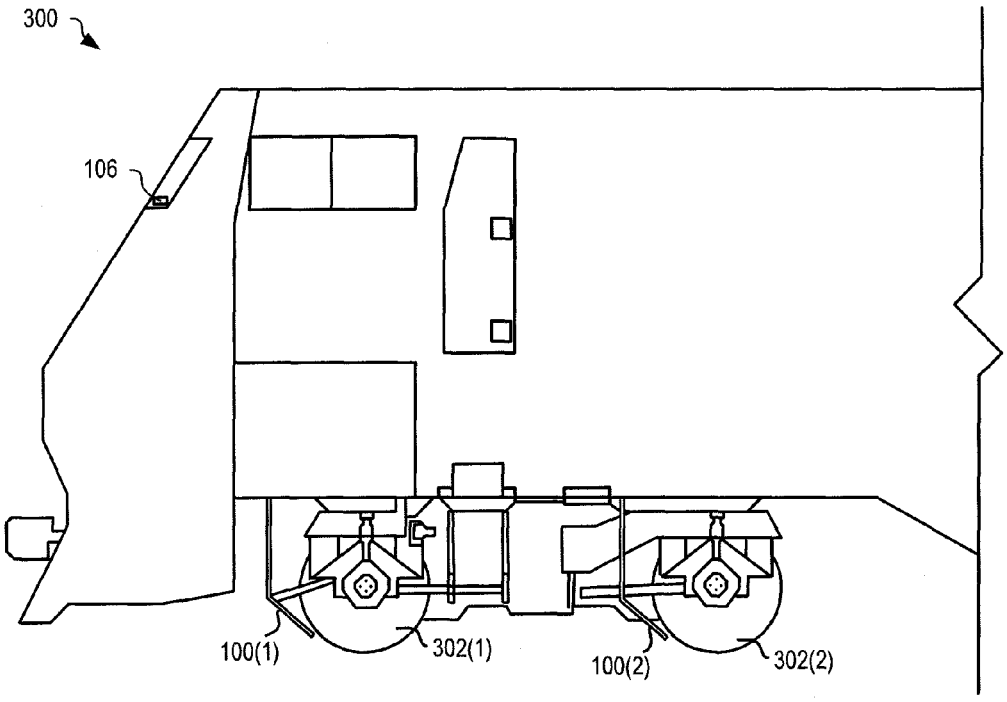
FIG. 3 shows an exemplary implementation of a heated sand tube system.

FIG. 3 shows exemplary implementation of sand tube system 100 as used in conjunction with a locomotive 300. Sand tube system 100 is mounted in front of the locomotive wheel 302. Multiple sand tube systems 100 may be implemented on the locomotive 300 in front of each wheel 302(1) and 302(2). Thermostat controller 106 may be coupled to electrical heating element 102 in such a way that the thermostat controller 106 is located in the cab of the locomotive to allow the operator of the locomotive to exactly control the temperature of the electrical heating element 102 without leaving the cab. Sand tube system 100 insures that the sand inside sand tube 102 is not frozen and can be applied to track 304 while the locomotive 300 is in use thus properly keeping the sand tube in compliance with federal regulations.

Figure 4:
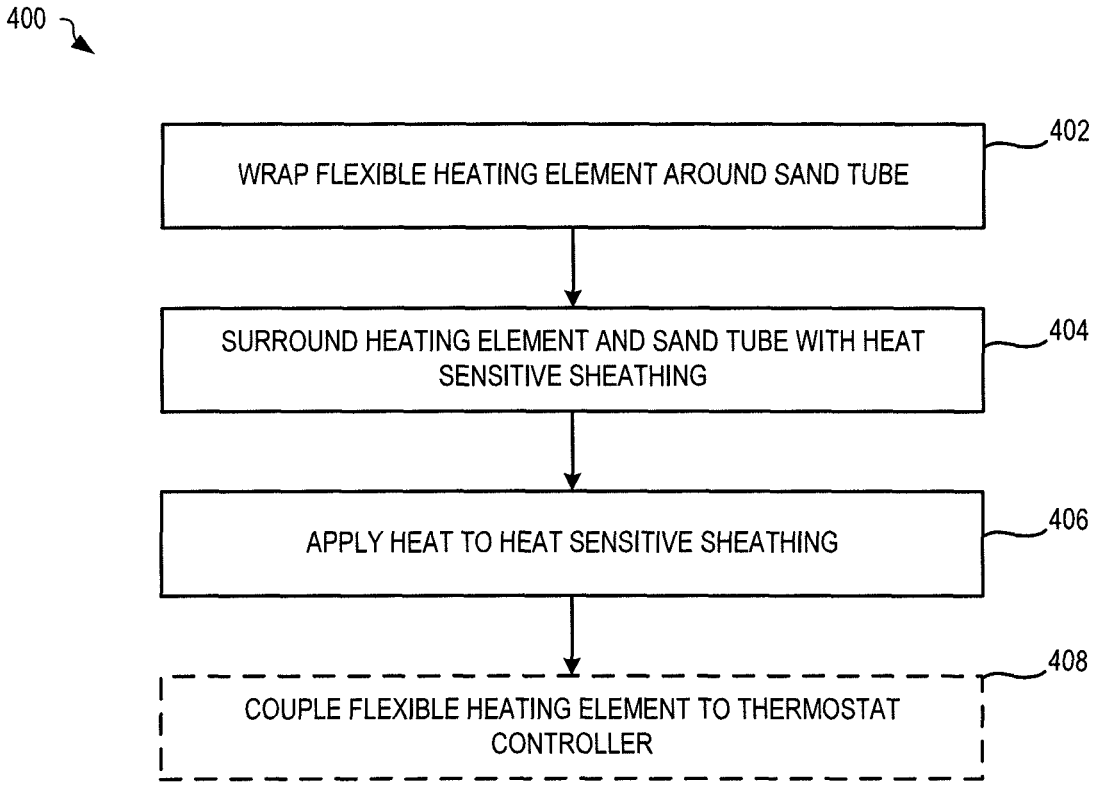
FIG. 4 depicts a method for manufacturing an efficient sand tube heater, in one embodiment.

FIG. 4 depicts an exemplary method 400 for manufacturing an efficient sand tube heater, in one embodiment.

In step 402, a sand tube is wrapped with a flexible electrical heating element. For example, flexible heating element 104 is wrapped around sand tube 102, of FIGS. 1-3. In one embodiment, flexible heating element is closely wrapped such that substantially the entire outer surface of the sand tube is covered by flexible heating element. In another embodiment, the flexible heating element is wrapped such that there are gaps between each wrapped portion of the heating element (i.e. as illustrated in FIG. 1).

In step 404, sand tube and surrounding flexible heating element of step 402 is surrounded with a heat sensitive sheathing. For example, flexible heating element 104 wrapped around sand tube 102 is surrounded with heat sensitive sheathing 108, of FIGS. 1-2.

In step 406, heat is applied to the heat sensitive sheathing such that the heat sensitive sheathing shrinks around the flexible heating element and sand tube. This causes the flexible heating element to tightly wrap around the sand tube such that the flexible heating element remains in constant contact with the sand tube. For example, heat is applied to heat sensitive sheathing 108 such that flexible heating element 104 remains in contact with sand tube 102 as illustrated in FIG. 1.

In optional step 408, the flexible heating element is coupled to a thermostat controller. For example, flexible heating element 104 is coupled to electrical thermostat controller 106 as illustrated in FIG. 1. Further, in one embodiment, electrical thermostat controller 106 is located within the operator cab of a locomotive as illustrated in FIG. 3.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A system for heating a sand tube for distributing sand in front of a vehicle's wheel, the system comprising:

a flexible electrical heating element coiled around the sand tube such that a portion of the flexible electrical heating element is in contact with the sand tube; and a heat sensitive sheathing wrapped around the outer surface of the sand tube and overlying the flexible electrical heating element; and wherein the heat is applied to the heat sensitive sheathing to cause it to shrink in a manner such that the flexible electrical heating element is held in direct contact with the tube.

2. The system for heating and distributing sand of claim 1 further comprising an electrical thermostat coupled to the flexible electrical heating element.

3. The system for heating and distributing sand of claim 2 wherein the electrical thermostat varies heat produced by the flexible electrical heating element between a range of heat as determined by an operator.

4. The system for heating and distributing sand of claim 3 wherein the range of heat has a maximum of 400 degrees Fahrenheit.

5. A method for heating and distributing sand in front of a vehicle's wheel comprising:

wrapping a tube for distributing sand in a flexible electrical heating element;

wrapping the tube and flexible electrical heating element with a heat sensitive sheathing; and applying heat to the heat sensitive sheathing so that the heat sensitive sheathing permanently shrinks onto the tube such that the flexible electrical heating element remains in constant and direct contact with the tube.

6. The method of claim 5 further comprising coupling the electrical heating element to an electrical thermostat controller.

7. The method of claim 6 further comprising applying an electrical current from the thermostat controller to the flexible electrical heating element to produce heat.

8. The method for heating and distributing sand in front of a vehicle's wheel of claim 7 wherein the electrical current is varied by the electrical thermostat controller to generate a range of heat from the flexible electrical heating element.

9. The method for heating and distributing sand in front of a vehicle's wheel of claim 8 wherein the range of heat has a maximum of 400 degrees Fahrenheit.

* * * * *